US007012988B2

(12) United States Patent
Adler et al.

(10) Patent No.: US 7,012,988 B2
(45) Date of Patent: Mar. 14, 2006

(54) METHOD OF CONTROLLING X-RAY AND X-RAY APPARATUS THEREFOR

(75) Inventors: Rolf Adler, Bensheim (DE); Michael Dalpiaz, Zwingenberg (DE)

(73) Assignee: Sirona Dental Systems GmbH, Benshiem (DE)

( * ) Notice: Subject to any disclaimer, the term of this patent is extended or adjusted under 35 U.S.C. 154(b) by 19 days.

(21) Appl. No.: 10/892,439

(22) Filed: Jul. 16, 2004

(65) Prior Publication Data

US 2005/0013409 A1 Jan. 20, 2005

(30) Foreign Application Priority Data

Jul. 16, 2003 (DE) ..... 103 32 417

(51) Int. Cl.
*H05G 1/38* (2006.01)
*H05G 1/26* (2006.01)

(52) U.S. Cl. ..... 378/101; 378/96; 378/111; 378/112

(58) Field of Classification Search ..... None
See application file for complete search history.

(56) References Cited

U.S. PATENT DOCUMENTS

| | | | | |
|---|---|---|---|---|
| 4,039,811 | A * | 8/1977 | Ennslin et al. | 378/112 |
| 4,142,103 | A * | 2/1979 | Mester et al. | 378/108 |
| 4,377,748 | A * | 3/1983 | Aichinger et al. | 378/110 |
| 4,578,767 | A * | 3/1986 | Shapiro | 702/64 |
| 4,652,985 | A * | 3/1987 | Bougle | 363/37 |
| 5,966,425 | A * | 10/1999 | Beland | 378/108 |
| 6,754,307 | B1 * | 6/2004 | Brendler et al. | 378/108 |

* cited by examiner

*Primary Examiner*—Craig E. Church
*Assistant Examiner*—Krystyna Suchecki
(74) *Attorney, Agent, or Firm*—Dykema Gossett PLLC

(57) ABSTRACT

The invention relates to a method of controlling an X-ray apparatus containing an X-ray emitter. Control means for the X-ray apparatus are provided with exposure time correction data for given mains voltages and the current mains voltage is measured before and/or during exposure and the exposure time is corrected in accordance with the correction data, and to an X-ray apparatus for carrying out said method.

14 Claims, 2 Drawing Sheets

METHOD OF CONTROLLING X-RAY AND X-RAY APPARATUS THEREFOR

TECHNICAL FIELD

The invention relates to a method of controlling an X-ray apparatus equipped with an X-ray emitter, and to an X-ray apparatus therefor. In the case of AC emitters in which the X-ray emitter is directly connected to a high-voltage transformer and for reasons of cost no high-voltage and tube-current regulation means are provided, mains fluctuations will cause dosage fluctuations which will have a noticeable effect on the density of the radiographs.

BACKGROUND OF THE INVENTION

With such apparatus a desired image quality is ensured in that the emitter control means permit radiographic imaging only within a very restricted mains voltage range. If the voltage was wrong, radiation was simply blocked or a pre-transformer was switched to a different setting.

SUMMARY OF THE INVENTION

According to the invention, the method of controlling an X-ray apparatus equipped with an X-ray emitter consists in that the X-ray apparatus has collected exposure time correction data applicable to different mains voltages in a step-wise procedure and that the current mains voltage is measured before and/or during exposure and the exposure time is corrected in accordance with said correction data.

By correlating the mains voltage to the dose required for image creation via correction data for the exposure time, as set up in a reference table, it is possible to dispense with high-voltage and/or tube-current control means. The dosage fluctuations caused by variations in the mains voltage are balanced out by correction of the exposure time.

An advantageous way of measuring the current mains voltage is achieved by making use of analog-digital conversion (A-D).

In another advantageous embodiment of the method of the invention, control of the X-ray apparatus is effected with the aid of a control program, since in this way it is possible to automate the method steps.

Another advantage is gained when the control program uses parameters taken from an existing table of data, since in this way an arbitrary number of data can be made available.

Advantageously, the corrected exposure time is made known to the operator of the X-ray apparatus after the image has been created, to make it possible for the operator to estimate the applied radiation impact.

A further advantage is gained by the provision of means which enable the apparatus to be reset to the standby mode. Such means might comprise, for example, a button or key disposed at a conspicuous location.

According to one advantageous development, a reference dose is set for a reference mains voltage such that when the control means for the X-ray emitter operates at the reference mains voltage, the reference exposure time is used.

The invention also relates to an X-ray apparatus equipped with an X-ray emitter and control means. The fact that correcting means for the exposure time of the X-ray emitter are present which comprise exposure time correction data and a measuring device for the current mains voltage, combined with the fact that the control unit is such that the exposure time correction data relevant to the measured mains voltage can be discerned, obviates the use of an expensive pretransformer.

The exposure time correction data for different mains voltages can be stored in a table of data. This table of data is provided ex works or is set up on site during installation work and is optionally revised when carrying out maintenance work.

Advantageously, the equipment includes an A-D converter to make it possible to measure the current mains voltage.

BRIEF DESCRIPTION OF THE DRAWINGS

The method of the invention is explained with reference to the drawings, in which.

EXAMPLE

Figure 1:
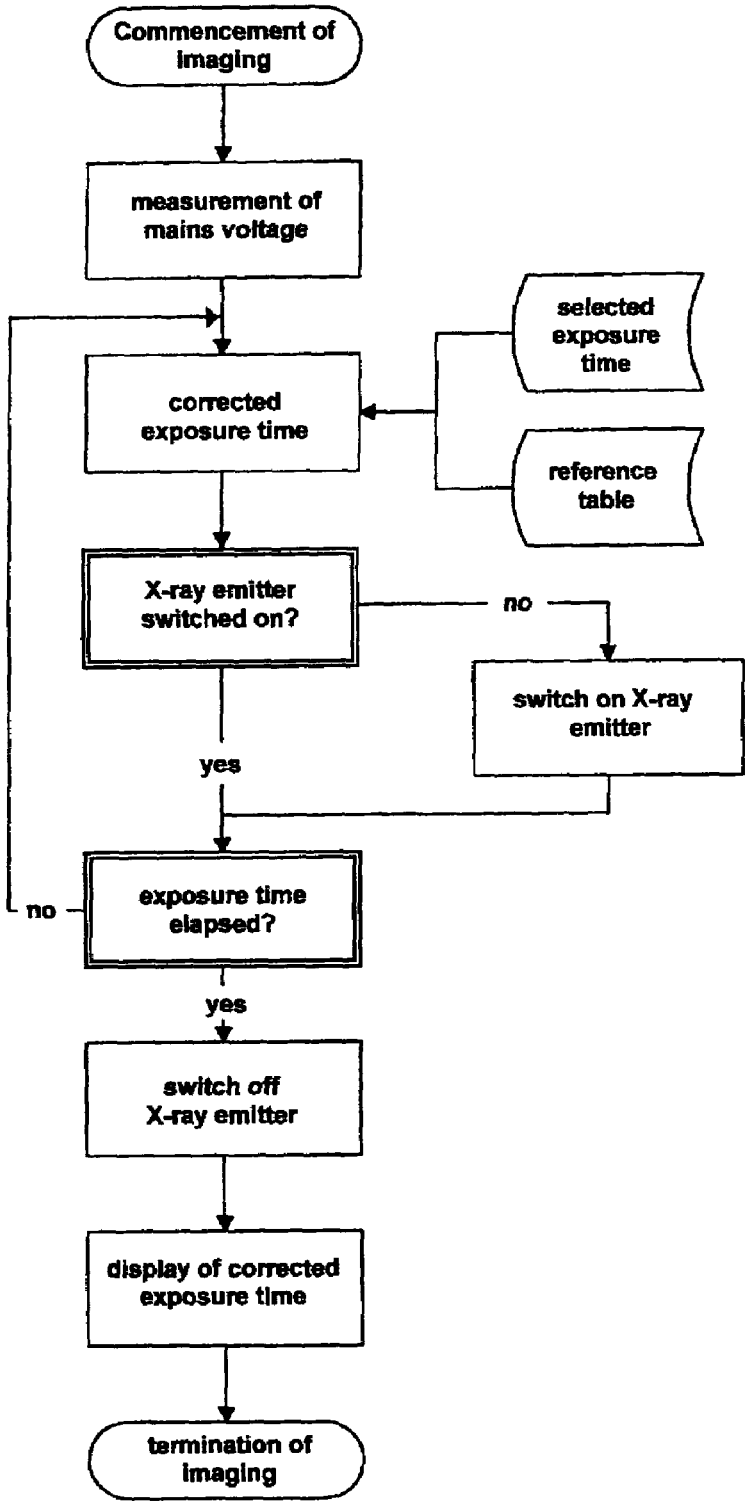
FIG. 1 is a flow chart relating to the method.
Figure 2:
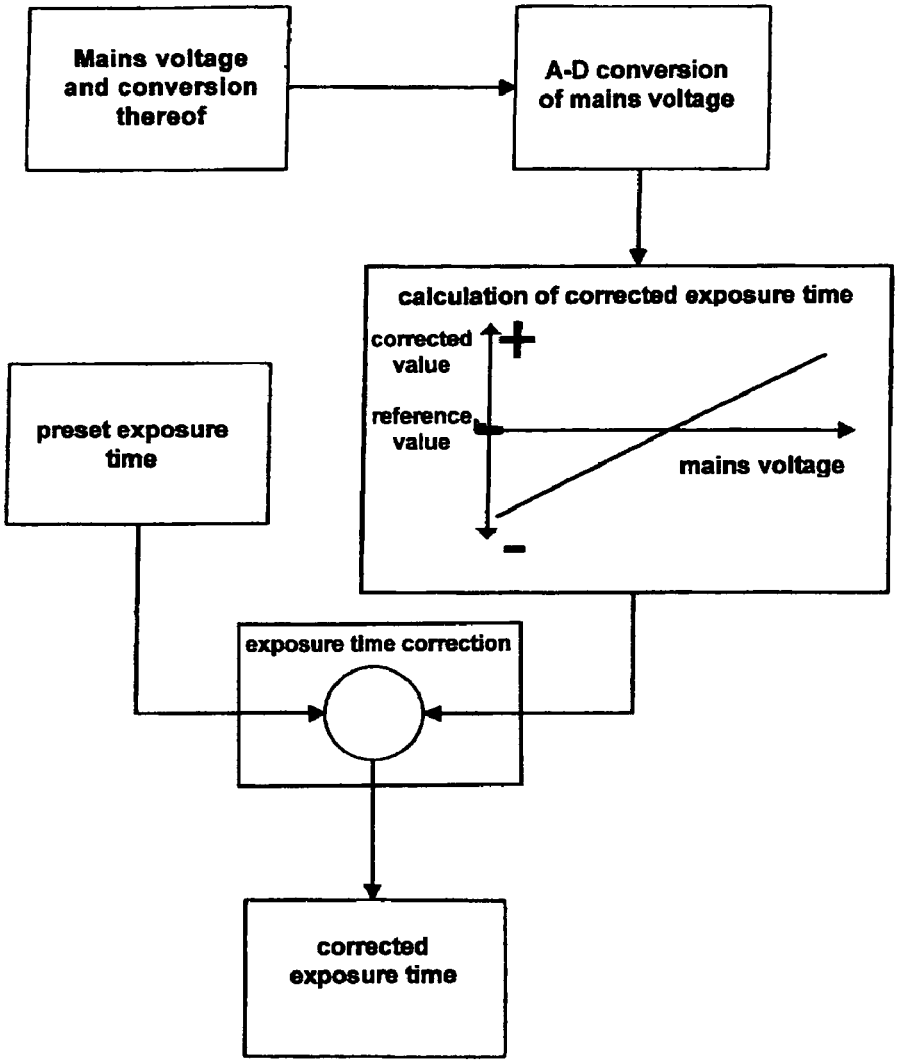
FIG. 2 shows diagrammatically the structure of the X-ray apparatus.

The X-ray apparatus comprises a high-voltage transformer connected to the mains. To the high-voltage transformer there is connected an X-ray emitter. With the aid of an A-D converter it is possible to convert the mains voltage for measurement purposes.

Mains voltage-dependent correction data for the exposure time are stored in a table of data and are read by the control program of the X-ray apparatus before or during imaging. The table can if necessary be replaced by a table containing updated reference data. Instead of a table, use can be made of an algorithm which determines the exposure time for a given mains voltage.

A reference dosage is fixed for a reference mains voltage. When the control unit of the emitter operates at this mains voltage, the exposure time is not corrected.

The method is carried out in the following manner. After starting up the X-ray apparatus but before switching on the X-ray emitter, the current mains voltage is measured and the exposure time, preset by the operator or by an X-ray program installed in the X-ray apparatus, is corrected in accordance with the table of data. This may be carried out prior to and/or during the exposure. The corrected exposure time is indicated to the operator of the X-ray apparatus prior to and/or after the exposure.

The X-ray apparatus can be designed such that the operator must switch it back to standby mode by actuating a reset key, in order to make him aware of the deviation from the reference voltage. However, such manual resetting is technically not absolutely necessary.

In order to prevent the exposure time corrections from becoming too large and in order not to exceed the mandatory statutory tolerances of the radiation doses, the X-ray apparatus is coarsely adjusted to the existing mains voltage during installation thereof. In this way it is possible to cover mains voltages ranging from 220 to 240V or from 100 to 120V with a single model.

What is claimed is:

1. A method of controlling an X-ray apparatus equipped with an X-ray emitter, comprising the steps of providing a control unit for said X-ray apparatus which provides mains voltage-dependent exposure time correction data, measuring the current mains voltage before and/or during exposure, and correcting the exposure time in accordance with said correction data.

2. A method as defined in claim 1, wherein the current mains voltage is measured with the aid of an A-D converter.

3. A method as defined in claim 1, wherein control of said X-ray apparatus is effected with the aid of a control program.

4. A method as defined in claim 1, comprising the further step of accessing a previously set up table of data by said control unit.

5. A method as defined in claim 1, comprising the further step of indicating the corrected exposure time to an operator of said X-ray apparatus after the exposure.

6. A method as defined in claim 1, comprising the further step of providing means resetting said apparatus to standby mode.

7. A method as defined in claim 1, comprising the further step of fixing a reference exposure time for a reference mains voltage such that when said control unit for said X-ray emitter operates at said reference mains voltage, said reference exposure time is used.

8. An X-ray apparatus having an X-ray emitter and control means, wherein correcting means for exposure time of said X-ray emitter are provided which comprise exposure time correction data and a measuring device for the current mains voltage, the control means being such that said exposure time correction data can be discerned for the measured mains voltage.

9. An X-ray apparatus as defined in claim 8, wherein said exposure time correction data applicable to different mains voltages are stored in a table of data.

10. An X-ray apparatus as defined in claim 8, wherein an A-D converter for measuring the current mains voltage is provided.

11. An X-ray apparatus as defined in claim 1, wherein an indication of the corrected exposure time of said X-ray apparatus is made available to an operator after the exposure.

12. An X-ray apparatus as defined in claim 8, wherein means are provided for resetting said apparatus to standby mode.

13. An X-ray apparatus as defined in claim 12, wherein means comprises at least one depressible key.

14. An X-ray apparatus as defined in claim 8, wherein said X-ray emitter is directly connected to a high-voltage transformer.

* * * * *